US008970872B2

(12) United States Patent
Ikeda

(10) Patent No.: US 8,970,872 B2
(45) Date of Patent: Mar. 3, 2015

(54) IMAGE FORMATION CONTROL APPARATUS, IMAGE FORMATION APPARATUS, IMAGE FORMATION SYSTEM, COMPUTER READABLE MEDIUM, AND TANDEM PRINTING SYSTEM

(75) Inventor: Kentaro Ikeda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1034 days.

(21) Appl. No.: 12/878,294

(22) Filed: Sep. 9, 2010

(65) Prior Publication Data

US 2011/0216352 A1 Sep. 8, 2011

(30) Foreign Application Priority Data

Mar. 8, 2010 (JP) ..... 2010-050310

(51) Int. Cl.
*G06F 3/12* (2006.01)
*G03G 15/23* (2006.01)
*G03G 15/01* (2006.01)

(52) U.S. Cl.
CPC ..... *G03G 15/238* (2013.01); *G03G 15/0178* (2013.01); *G03G 2215/00021* (2013.01)
USPC ..... 358/1.15; 358/1.12

(58) Field of Classification Search
CPC ..... G03G 15/0178; G03G 15/238
See application file for complete search history.

(56) References Cited

U.S. PATENT DOCUMENTS 5,548,390 A 8/1996 Sugisaki et al.
5,752,776 A 5/1998 Kunreuther
6,501,929 B1 12/2002 Warbus et al.
2002/0126307 A1 * 9/2002 Ohwa ..... 358/1.14
2003/0026619 A1 2/2003 Miyoshi et al.
2007/0247467 A1 10/2007 Kaneda
2007/0297841 A1 12/2007 Moore (Continued)

FOREIGN PATENT DOCUMENTS

CN A-101046732 10/2007
CN A-101059671 10/2007

(Continued)

OTHER PUBLICATIONS

Aug. 12, 2011 Office Action issued in Australian Patent Application No. 2010224345.

(Continued)

*Primary Examiner* — Saeid Ebrahimi Dehkordy
*Assistant Examiner* — Lennin Rodriguezgonzale
(74) *Attorney, Agent, or Firm* — Oliff PLC

(57) ABSTRACT

An image formation control apparatus includes a management unit, a communication unit, and a control unit. The management unit manages first image formation processing on a first face of a planar recording medium. The first image formation processing is performed by a first image formation apparatus. The communication unit communicates with a second image forming apparatus configured to perform image formation on a second face of the planar recording medium. The control unit performs control of transportation of the planar recording medium from the first image formation apparatus to the second image formation apparatus or from the second image formation apparatus. A first amount of time to start image formation from receiving an image formation instruction in the first image formation apparatus is smaller that a second amount of time to start image formation from receiving an image formation instruction in the second image formation apparatus.

1 Claim, 11 Drawing Sheets

(56) References Cited

U.S. PATENT DOCUMENTS

| | | | |
|---|---|---|---|
| 2008/0259389 | A1 | 10/2008 | Takahashi |
| 2009/0003913 | A1 | 1/2009 | Uchida |

FOREIGN PATENT DOCUMENTS

| | | | |
|---|---|---|---|
| CN | A-101290492 | | 10/2008 |
| EP | 1 939 005 | A1 | 7/2008 |
| JP | H-11-231580 | | 8/1999 |
| JP | A-2007-055186 | | 3/2007 |
| JP | A-2009-078408 | | 4/2009 |
| WO | WO 01/56802 | A1 | 8/2001 |
| WO | WO 2009/108204 | A1 | 9/2009 |

OTHER PUBLICATIONS

Australian Office Action dated Feb. 6, 2012 issued in Australian Patent Application No. 2010224345.

Office Action dated Nov. 12, 2013 issued in Japanese Patent Application No. 2010-050310 (with English translation).

Jul. 22, 2014 European Search Report issued in European Application No. 1017778.6.

Office Action dated May 28, 2014 issued in Chinese Patent Application No. 201010519044 (with translation).

* cited by examiner

IMAGE FORMATION CONTROL APPARATUS, IMAGE FORMATION APPARATUS, IMAGE FORMATION SYSTEM, COMPUTER READABLE MEDIUM, AND TANDEM PRINTING SYSTEM

CROSS-REFERENCE TO RELATED APPLICATIONS

This application is based upon and claims priority under 35 USC 119 from Japanese Patent Application No. 2010-050310, filed Mar. 8, 2010.

BACKGROUND

Technical Field

The present invention relates to an image formation control apparatus, an image formation apparatus, an image formation system, a computer readable medium, and a tandem printing system.

SUMMARY OF THE INVENTION

According to an aspect of the invention, an image formation control apparatus includes an image formation processing management unit, a communication unit, and a control unit. The image formation processing management unit manages first image formation processing on a first face of a planar recording medium. The first image formation processing is performed by a first image formation apparatus. The communication unit communicates with a second image forming apparatus configured to perform image formation on a second face of the planar recording medium. The second face is an opposing face with respect to the first face. A type of the first image formation apparatus is different from a type of the second image formation apparatus. The control unit performs control of transportation of the planar recording medium from the first image formation apparatus to the second image formation apparatus or from the second image formation apparatus. A first amount of time to start image formation from receiving an image formation instruction in the first image formation apparatus is smaller that a second amount of time to start image formation from receiving an image formation instruction in the second image formation apparatus. When an instruction to start image formation on the planar recording medium is issued, the control unit controls the transportation of the planar recording medium to transport the recording medium for a given time longer than the second amount of time without image forming on the planar recording medium.

BRIEF DESCRIPTION OF THE DRAWINGS

Exemplary embodiments of the invention will be described in detail based on the following figures, wherein.

DETAILED DESCRIPTION

Overall Configuration

Figure 1:
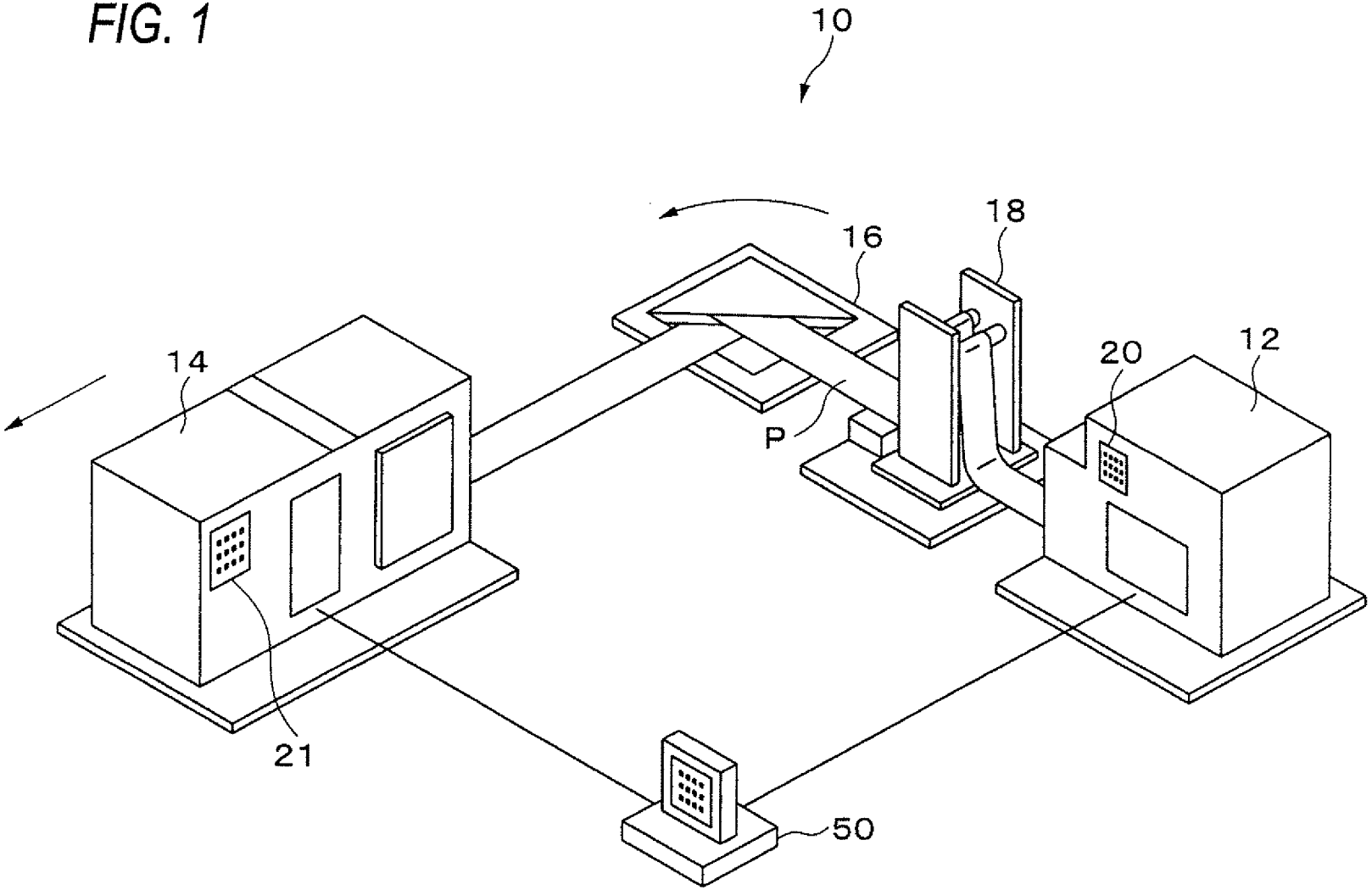
FIG. 1 is a perspective view showing a tandem printing system of an exemplary embodiment.
Figure 2:
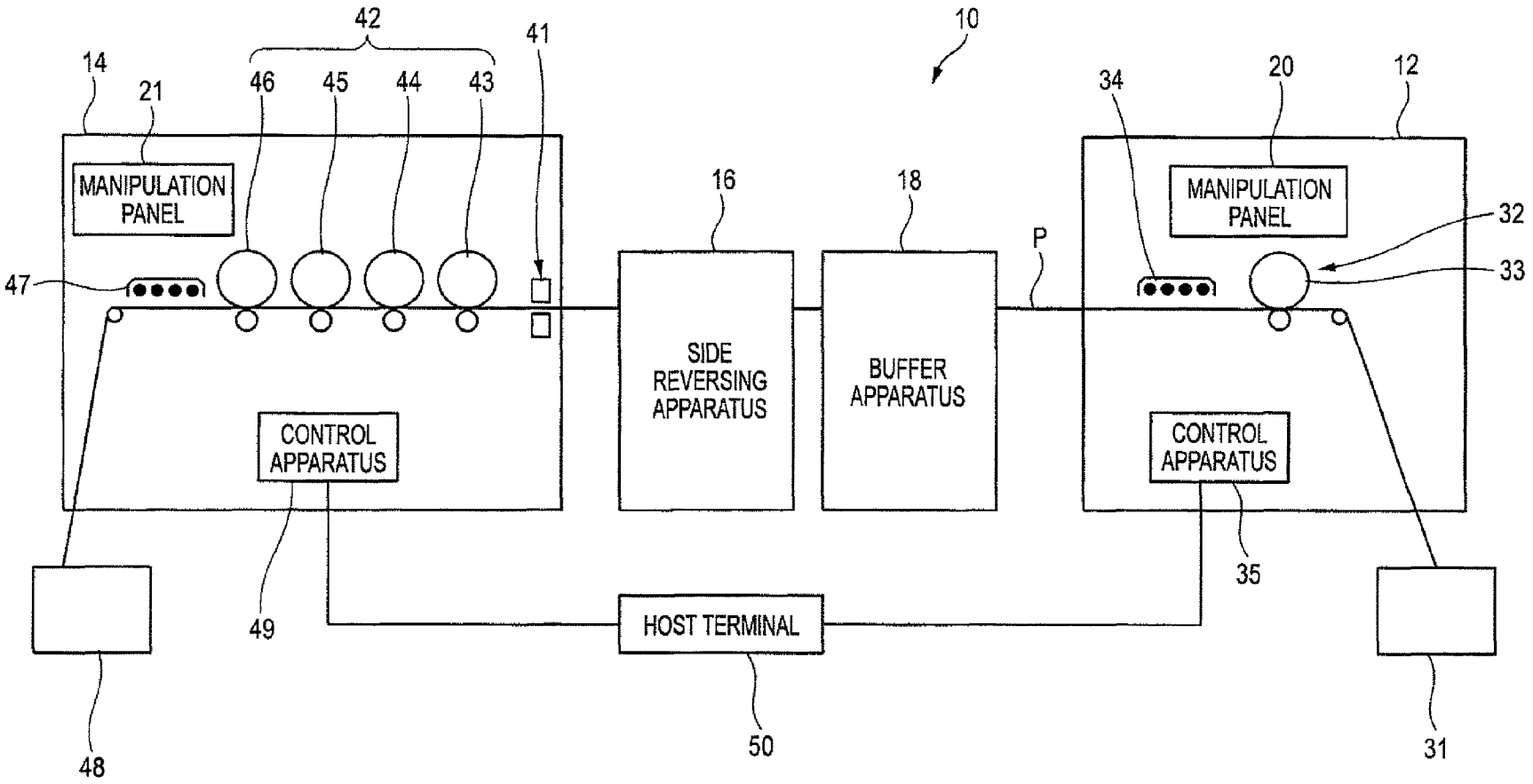
FIG. 2 is a conceptual view showing the tandem printing system of the exemplary embodiment.

A description will be given hereinbelow of an example in which the present invention is utilized. FIG. 1 shows an example of a tandem printing system in which the present invention is utilized. FIG. 2 shows a block diagram of the system in FIG. 1. Each of FIGS. 1 and 2 shows a tandem printing system 10. The tandem printing system 10 has a function of performing image formation on front and back sides (faces) of continuous paper as an example of a planar recording medium by utilizing image formation apparatuses 12 and 14.

First, the image formation apparatus 12 is disposed on the upstream side in terms of a transport path of the paper. The image formation apparatus 12 is a monochrome printer for forming a single color image (a black-and-white image in this case), and externally includes a roll paper feeding apparatus 31 that feeds the continuous paper wound in a roll shape. On the downstream side of the roll paper feeding apparatus 31, there is disposed a transfer unit 32 that transfers a toner image to a continuous paper P sent out from the roll paper feeding apparatus 31. The transfer unit 32 includes a photosensitive drum 33. The photosensitive drum 33 is irradiated with an image-drawing laser beam from an exposure apparatus that is not shown, and an electrostatic latent image is thereby formed. The electrostatic latent image is developed using a black toner by a development apparatus that is not shown, and a monochrome toner image is thereby formed. The toner image is transferred to the continuous paper P.

On the downstream side of the transfer unit 32, a fixing apparatus 34 is disposed. The fixing apparatus 34 irradiates the toner image on the continuous paper P with strong light to fix it onto the continuous paper P. The image formation apparatus 12 includes a control apparatus 35. The control apparatus 35 controls an operation of the image formation apparatus 12. The detail of the control apparatus 35 will be described later.

The image formation apparatus 12 forms a positioning mark that will be described later on the continuous paper P. The positioning mark is read by the image formation apparatus 14 on the downstream side, and is used for positioning when image formation with respect to the back side of the continuous paper P is performed in the image formation apparatus 14.

The image formation apparatus 12 includes a manipulation panel 20. The manipulation panel 20 is a touch panel display, and is used for various manipulations by an operator. In addition, the manipulation panel 20 displays various information items for the operator.

The paper P formed with an image on one side in the image formation apparatus 12 is sent to a buffer apparatus 18. The buffer apparatus 18 has a function of bending the continuous paper P during transport inside the buffer apparatus 18 to eliminate looseness, a twist, a flutter, and an excessive tension of the continuous paper P.

On the downstream side of the buffer apparatus 18, a side reversing apparatus 16 is disposed. The side reversing apparatus 16 reverses the front and back sides (upper and under sides) of the continuous paper P, and sends the paper P to the image formation apparatus 14 on the downstream side.

The continuous paper P of which the front and back sides are reversed by the side reversing apparatus 16 is sent to the image formation apparatus 14 where the image formation is performed with respect to a side opposite to the side formed with the image by the image formation apparatus 12. Herein, the image formation apparatus 14 is configured to be capable of color image formation.

The image formation apparatus 14 includes an optical sensor 41. The optical sensor 14 optically detects the positioning mark formed on the continuous paper P in the image formation apparatus 12. On the downstream side of the optical sensor 41, a transfer unit 42 is disposed. The transfer unit 42 includes photosensitive drums 43, 44, 45, and 46 for forming toner images of basic colors of YMCK. The configuration of each of the photosensitive drums 43, 44, 45, and 46 is the same as that of the photosensitive drum 33 in the image formation apparatus 12 except the toner colors to be used.

In the transfer unit 42, toner images are formed on the side opposite to the side formed with the image in the image formation apparatus 12. On the downstream side of the transfer unit 42, a fixing apparatus 47 is disposed. Similarly to the fixing apparatus 34, the fixing apparatus 47 irradiates toner images on the continuous paper P with strong light to fix them onto the continuous paper P. On the downstream side of the fixing apparatus 47, there is externally disposed a paper winding apparatus 48 that winds up the continuous paper P formed with the images on both sides.

The image formation apparatus 14 includes a control apparatus 49. The control apparatus 49 controls an operation of the image formation apparatus 14. The detail of the control apparatus 14 will be described later. The image formation apparatus 14 includes a manipulation panel 21. The manipulation panel 21 is a touch panel display, and is used for various manipulations by the operator. In addition, the manipulation panel 21 displays various information items for the operator.

The tandem printing system 10 includes a host terminal 50. The host terminal 50 is a terminal that performs manipulations related to the operation of the tandem printing system 10. It is also possible to manipulate the tandem printing system 10 using the manipulation panel 20 or 21 without disposing the host terminal.

In the above-described tandem printing system 10, there is used the positioning mark that functions as a mark in order to match the positions of the images on the front and back sides when printing is performed with respect to both sides of the continuous paper P. Specifically, the positioning mark is formed in the image formation apparatus 12, the positioning mark is optically detected by the optical sensor 41 in the image formation apparatus 14 in the image formation with respect to the back side in the image formation apparatus 14, and, on the basis of the detected positioning mark, the image formation with respect to the second side that corresponds to the position of the image formed on the first side is performed in the image formation apparatus 14. The positioning mark is formed in an inconspicuous area close to the edge of the continuous paper or the like.

(Configuration of Control System)

Figure 3:
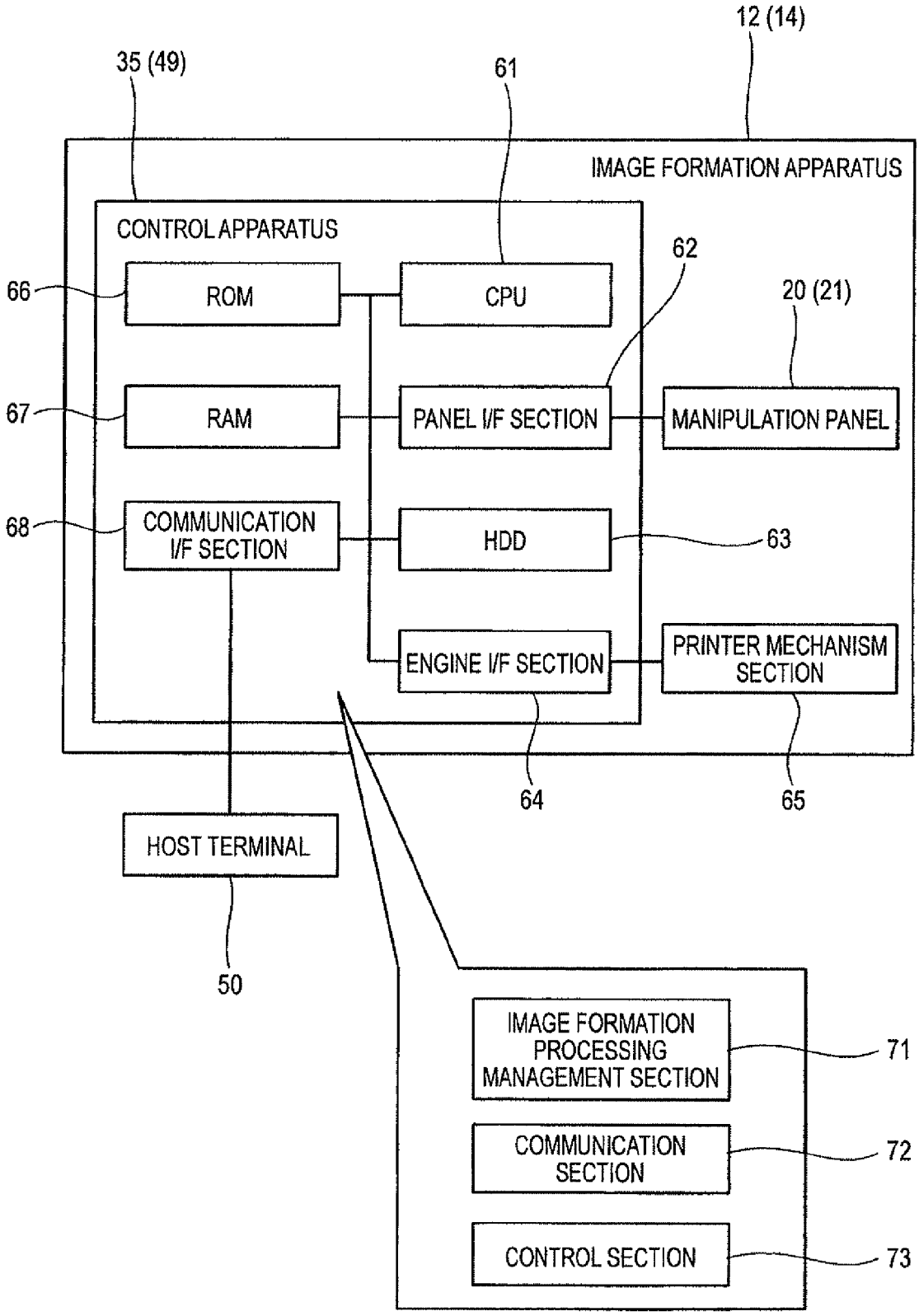
FIG. 3 is a block diagram of a control system of the exemplary embodiment.

FIG. 3 shows a control system of each of the image formation apparatuses 12 and 14. Herein, the image formation apparatus 12 is only for monochrome printing, while the image formation apparatus 14 is capable of color printing. However, when considered as control blocks, they have the same basic configuration.

Each of the control apparatuses 35 and 49 is an apparatus functioning as a computer, and includes a CPU 61, a panel I/F section 62, a HDD 63, an engine I/F section 64, a ROM 66, a RAM 67, and a communication I/F section 68. The CPU 61 is a device that exercises control over the operation of the control apparatus 35 (49), and executes a flow chart described later. In addition, the function of the CPU 61 allows various processing related to an image formation operation to be performed. The panel I/F section 62 is an interface apparatus that connects between the manipulation panel 20 (21) and the control apparatus 35 (49). The HDD 63 is a hard disk apparatus that stores various information items.

The engine I/F section 64 is an interface apparatus that intervenes between a printer mechanism section 65 and the control apparatus 35 (49). The printer mechanism section 65 corresponds to a mechanism portion for performing the image formation operation inside the image formation apparatus 12 (14) and a mechanism portion related to the transport of the continuous paper. The image formation apparatus 12 is a monochrome printer, while the image formation apparatus 14 is a color printer. Due to this difference, the printer mechanism sections 65 and 65 of the image formation apparatuses 12 and 14 have different configurations, though the depiction thereof is omitted.

The ROM 66 stores programs for performing operations described later and various set items. The RAM 67 functions as a memory area that temporarily stores image data of an image to be formed and various data. The communication I/F section 68 is an interface apparatus for performing communication with the outside of the apparatus. For example, the communication I/F section 68 functions as a communication apparatus when the image formation apparatus 12 communicates with the image formation apparatus 14 via the host terminal 50.

In addition, in terms of its function, the control apparatus 35 of the image formation apparatus 12 is considered to have a configuration that includes an image formation processing management section 71, a communication section 72, and a control section 73. The image formation processing management section 71 manages image formation processing with respect to the first side of the continuous paper P. The communication section 72 performs communication with the image formation apparatus 14 on the downstream side that has a type different from that of the image formation apparatus 12, and performs image formation with respect to the second side of the continuous paper P.

The control section 73 performs control (control of blank paper sending described later) of sending out the continuous paper P to the image formation apparatus 14 without performing the image formation processing with respect to the first side during a time period not less than a time period from a time when the continuous paper P reaches the image formation apparatus 14 on the downstream side to a time when the image formation with respect to the second side in the image formation apparatus 14 is performed (i.e., a time period when registration processing described layer is performed).

(Operation Principle)

Figure 4A:
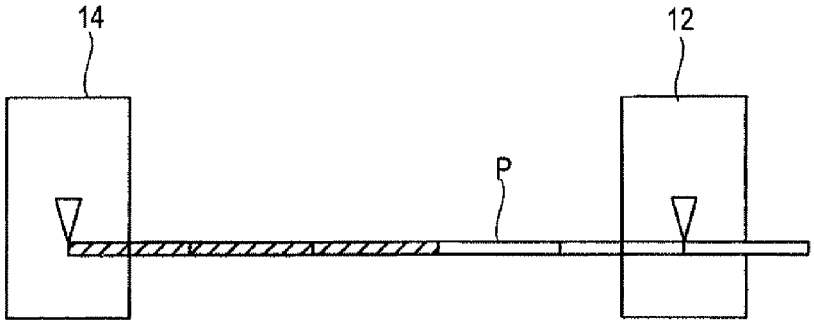
FIGS. 4A to 4C are principle views explaining a principle of a displacement of images when duplex printing is performed.
Figure 4B:
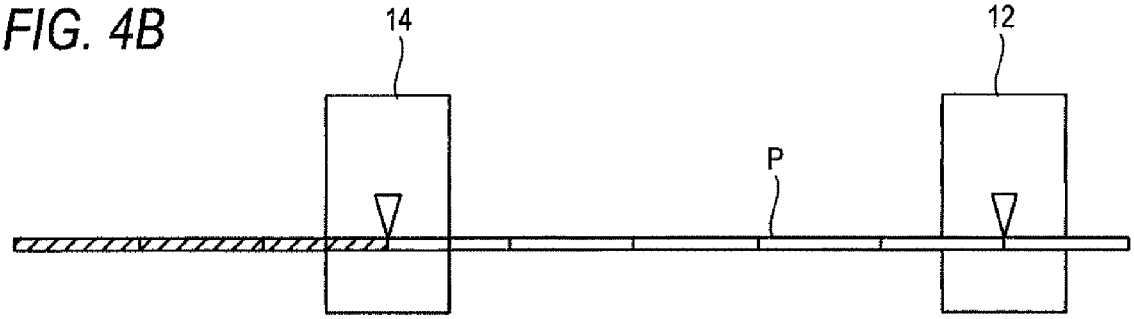
Figure 4C:
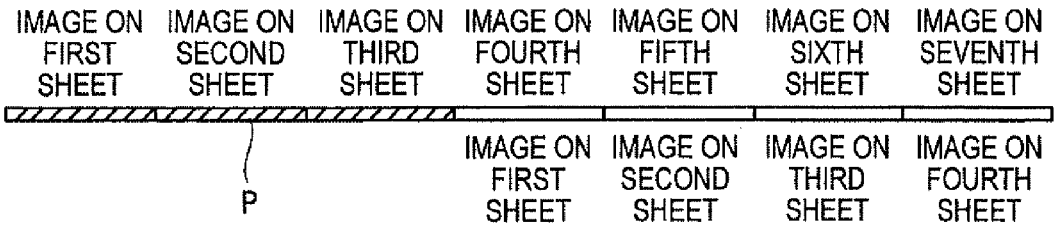

A description will be given hereinbelow of an operation principle of the tandem printing, system 10 shown in FIG. 1. FIGS. 4A to 4C conceptually show the tandem printing system 10. Herein, consideration is given to the case where the image formation with respect to the first side of the continuous paper P is performed in the image formation apparatus 12, and the image formation with respect to the second side thereof is performed in the image formation apparatus 14. It is assumed herein that the image formation apparatus 14 needs processing in which the continuous paper P equivalent to three sheets of a given standard size is firstly transported in the apparatus, and a function of matching formation positions of images of four colors of YMCK is initialized during the transport in order to perform image formation using four photosensitive drums.

The processing will be described hereinbelow. The image formation apparatus 14 includes the four photosensitive drums 43 to 46, as shown in FIG. 2. Individual toner images of YMCK are formed on the individual photosensitive drums, and transferred to the continuous paper P, whereby a color image is formed. In the processing, it is necessary to superimpose the toner images of YMCK with high precision. Accordingly, processing for adjusting the transfer position on the continuous paper P with respect to the portions of the individual photosensitive drums is performed. In this processing, the continuous paper P is transported in the image formation apparatus 14, the images of YMCK are actually formed and superimposed on an edge of the continuous paper P or the like, the image is detected using an optical sensor (the depiction thereof is omitted), and the state of superimposing of the individual colors is determined. On the basis of the determination, timing for forming the individual images of YMCK or the like is adjusted, and adjustment is thereby performed such that the images of YMCK are superimposed with high precision. In the description below, the procedure for this adjustment is referred to as "registration".

On the basis of the above-described assumption, a description will be given firstly of the case where the present invention is not utilized. In this case, in the state where the continuous paper P is being transported in a direction from the image formation apparatus 12 toward the image formation apparatus 14, the formation of the image and the positioning mark on one side of the continuous paper P is performed in the image formation apparatus 12. Subsequently, at the stage where the leading end of the continuous paper P reaches the image formation apparatus 14, the registration processing of the image formation position in the image formation apparatus 14 is started. This state is shown in FIG. 4A.

As described above, in this case, in order to complete the registration processing in the image formation apparatus 14, it is necessary to move the continuous paper P equivalent to three sheets of a given standard size from the start of the processing. Consequently, as shown in FIG. 4B, at the stage where the continuous paper P formed with the image on one side by the image formation apparatus 12 has further moved (passed) by the distance equivalent to the three sheets, the image formation with respect to the other side in the image formation apparatus 14 is started. Accordingly, in the operation form described above, the images on one side and the other side are displaced from each other by three sheets of the given standard size. This state is shown in FIG. 4C.

Figure 5A:
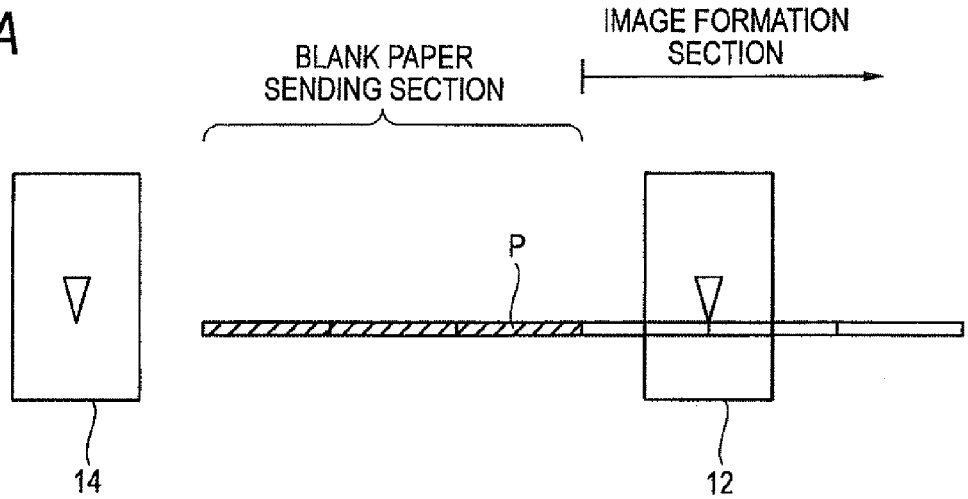
FIGS. 5A to 5C are principle views showing a principle of the exemplary embodiment.
Figure 5B:
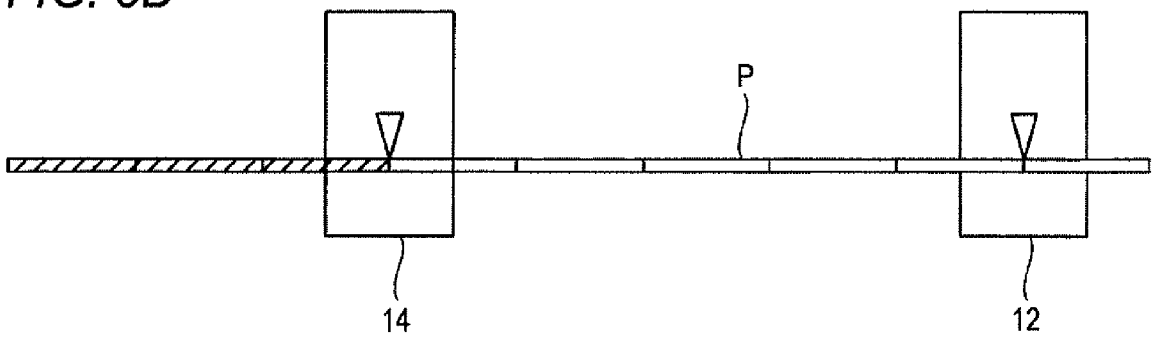
Figure 5C:
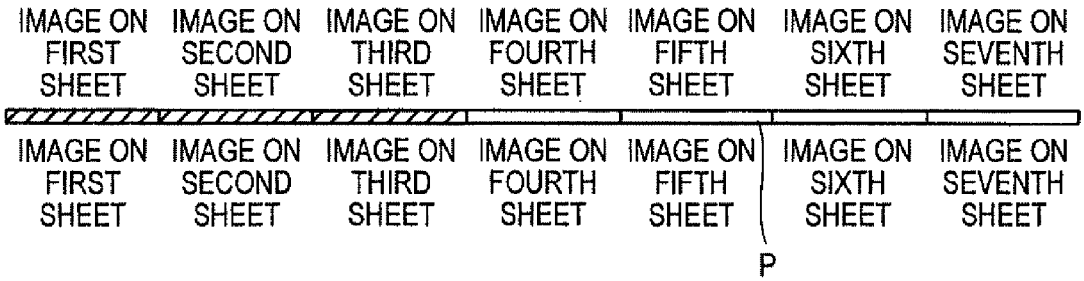

Next, a description will be given of an example of an operation form (an example of an operation form of the present invention) that eliminates the inconvenience of which the principle is shown in FIGS. 4A to 4C. FIGS. 5A to 5C are principle views explaining a principle of the example of the operation form of the present invention. In this case, blank paper sending equivalent to three sheets of the given standard size is performed at the point of time when the transport of the continuous paper P is started in the image formation apparatus 12 and, thereafter, the image formation is started from the fourth sheet. The blank paper sending mentioned herein means processing in which the continuous paper P is transported toward the downstream side in the state where the image formation is not performed, and only the formation of the positioning mark is performed with respect to the continuous paper P.

With the processing shown in FIGS. 5A to 5C, the continuous paper P having been subjected to the blank paper sending described above passes through the image formation apparatus 14 during the time period when the registration processing in the image formation apparatus 14 is performed, and the image formation with respect to the second side in the image formation apparatus 14 is started from the fourth sheet after the blank paper sending. Specifically, an operation is realized in which, during the time period when the registration processing in the image formation apparatus 14 is performed, a portion of the continuous paper formed with the image on the first side does not reach the position of the transfer unit 42 in the image formation apparatus 14.

In this case, as described above, the image formation apparatus 12 is set such that the image formation is also started from the fourth sheet so that it is possible to match the positions of the images on the front and back sides of the continuous paper P. This state is conceptually shown in FIG. 5C.

Operation Example 1

Figure 6:
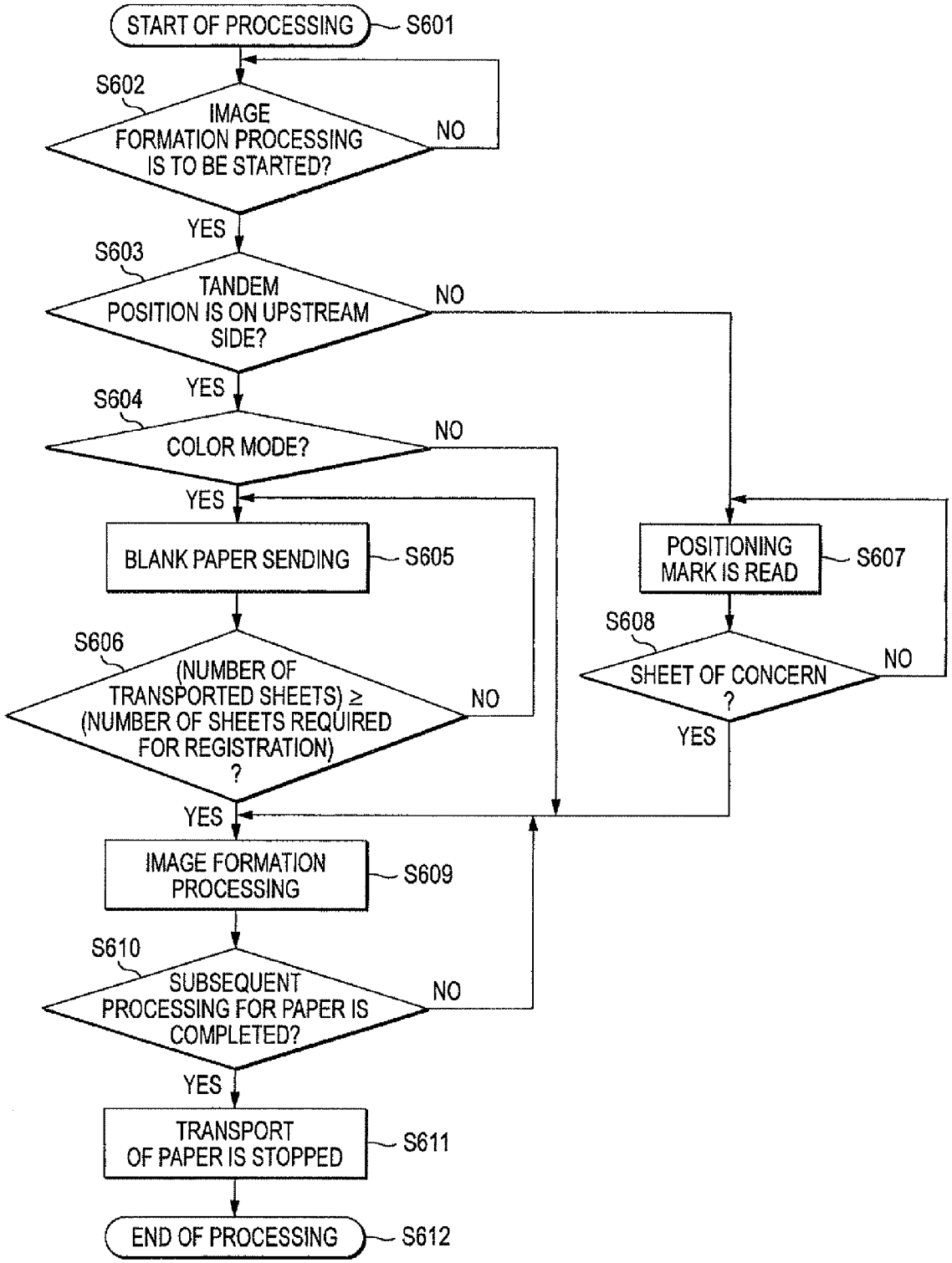
FIG. 6 is a flow chart showing an example of procedures of an operation of the exemplary embodiment.

An example of the specific operation will be described hereinbelow. FIG. 6 shows an example of procedures of the operation of the image formation apparatus 12 disposed on the upstream side. The processing in FIG. 6 is performed by executing a program stored in the image formation apparatus 12 by the control apparatus 35 in the image formation apparatus 12.

When the power of the system is turned ON, the processing is started (step S601). When the processing is started, it is determined whether or not image formation processing is to be started (step S602). When it is determined that the image formation processing is to be started, the procedure advances to a step S603 and, otherwise, the step S602 is repeated. In the step S603, it is determined whether or not the image formation apparatus of concern (i.e., the image formation apparatus 12) is disposed on the upstream side in the tandem printing system 10 (step S603). In the case shown in FIG. 1, the image formation apparatus 12 is disposed on the upstream side in the tandem printing system 10 so that the procedure advances to a step S604. When the image formation apparatus of concern is disposed on the downstream side in the tandem printing system, the procedure advances to a step S607.

In the step S604, it is determined whether or not the tandem printing system 10 is in a color mode (i.e., an operation mode including color image formation) (step S604). In this example, color printing is performed in the image formation apparatus 14 on the downstream side so that the tandem printing system 10 is in the color mode, and the procedure advances to a step S605. When the image formation apparatus 14 on the downstream side performs monochrome printing, the tandem printing system 10 is not in the color mode so that the procedure advances to a step S609.

In the step S605, the processing of the blank paper sending is performed. The processing of the blank paper sending is processing in which the formation of the image to be printed is not performed, only the positioning mark is formed, and the continuous paper P is sent out toward the downstream side.

After the step S605 is started, it is determined whether or not elapsed time of the sending out of the continuous paper P performed since the start of the procedure in the step S605 is not less than time required for the registration processing in the image formation apparatus 14 (step S606). In this processing, the elapsed time of execution of the sending out of the continuous paper P is converted into the number of sheets of the continuous paper P that are sent out during the elapsed time, and the number of sheet of the continuous paper P is used as one of parameters for comparison. In addition, the time required for the registration processing is converted into the number of sheets of the continuous paper P that pass an observation reference point, and the number of sheets of the continuous paper P is used as the other parameter for comparison. On the basis of these parameters, it is determined whether or not the number of transported sheets is not less than the number of sheets required for the registration in the image formation apparatus 14. This processing may be performed by carrying out arithmetic calculation on the basis of a transport distance covered by the transported continuous paper P.

In the step S606, when the number of transported sheets after the start of the blank paper sending is not less than the number of sheets required for the registration in the image formation apparatus 14, the procedure advances to the step S609 and, otherwise, the processing of the blank paper sending in the step S605 is continued. In the step S609, the image formation processing is started, and the image formation with respect to the first side by the image formation apparatus 12 is started. Subsequently, the transport of the continuous paper P is stopped (step S611) at the stage where subsequent processing such as winding of the continuous paper P or the like is completed, and the processing is ended (step S612).

In the case where the procedure advances from the step S603 to the step S607, the positioning mark formed by the image formation apparatus disposed on the upstream side is read (step S607) and, when the read positioning mark is on a sheet where the image is to be formed (a sheet of concern), the procedure advances to the step S609, and the image formation is performed (step S609). When the read positioning mark is not on the sheet of concern due to the stoppage of sheet transport caused by paper jamming or the like, the procedure returns to the step S607, and the positioning mark is read again.

When the image formation apparatus of concern 12 is disposed on the downstream side in the tandem printing apparatus, reading of the positioning mark formed by the image formation apparatus on the upstream side is performed for each sheet, and the depiction of the processing is omitted in the flow chart in FIG. 6.

Figure 7:
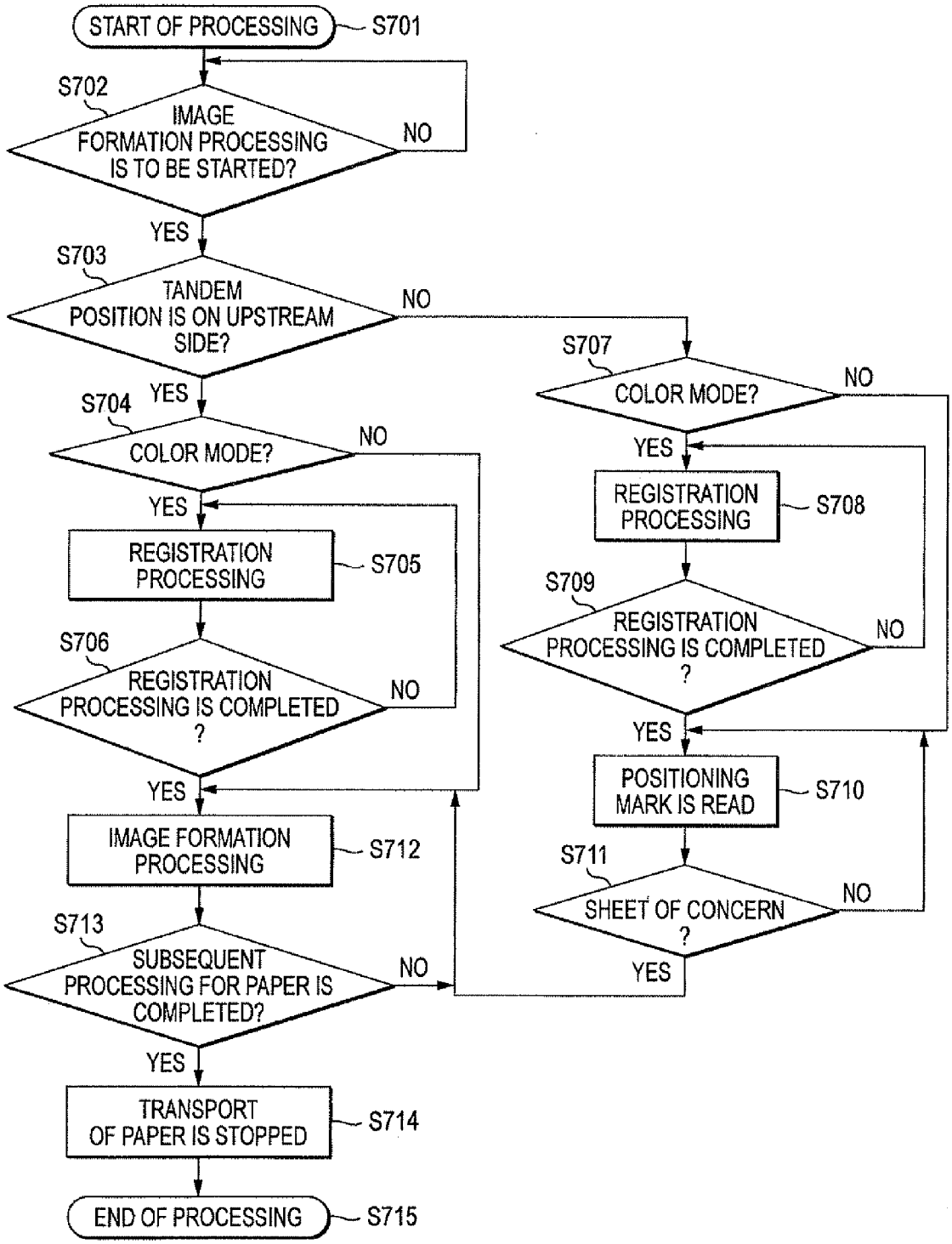
FIG. 7 is a flow chart showing an example of procedures of an operation of the exemplary embodiment.

Next, a description will be given of an example of processing in the image formation apparatus 14 to be paired with the image formation apparatus 12. FIG. 7 shows the example of the processing performed in the image formation apparatus 14. The processing in FIG. 7 is performed by executing a program stored in the image formation apparatus 14 by the control apparatus 49 in the image formation apparatus 14.

When the power of the system is turned ON, the processing is started (step S701). When the processing is started, it is determined whether or not the image formation processing is to be started (step S702). When it is determined that the image formation processing is to be started, the procedure advances to a step S703 and, otherwise, the procedure in the step S702 is repeated.

In the step S703, it is determined whether or not the image formation apparatus of concern (in this flow chart, the image formation apparatus 14) is disposed on the upstream side in the tandem printing system 10 (step S703). In this example, the image formation apparatus of concern 14 is disposed on the downstream side so that the procedure advances to a step S707. In the step S707, it is determined whether or not the tandem printing system 10 operates in the color mode (i.e., the tandem printing system 10 is in a printing mode including the color image) (step S707). When the color mode is set, the procedure advances to a step S708 and, otherwise, the procedure advances to a step S710.

In the step S708, the registration processing is started and thereafter, it is determined whether or not the registration processing is completed (step S709). When the registration processing is not completed yet, the procedures in and after S708 are repeated, while when the registration processing is completed, the procedure advances to the step S710. In the step S710, the positioning mark formed in the image formation apparatus 12 on the upstream side is read, and it is determined whether or not the read positioning mark is on a sheet on which the image is to be formed (a sheet of concern) (step S711). When the read positioning mark is on the sheet on which the image is to be formed (the sheet of concern), the procedure advances to a step S712 to perform the image formation and, otherwise, the procedure in the step S710 is repeated.

When the image formation apparatus of concern (the image formation apparatus 14) is disposed on the upstream side, the procedure advances to the step S704 from the step S703, and it is determined whether or not the operation mode of the tandem printing system 10 is the color mode. When the operation mode is the color mode, the registration processing is performed (step S705), and it is determined whether or not the registration processing is completed (step S706). When the registration processing is completed, the procedure advances to the step S712 and, otherwise, the procedure in the step S705 is continued.

After the image formation processing in the step S712 is started, it is determined whether or not subsequent processing for the continuous paper P is completed (step S713) and, when the subsequent processing for the continuous paper P is completed, the procedure advances to a step S714 to stop the transport, and the processing is ended (step S715).

(Feature of Operation Example 1)

As described above, in the present exemplary embodiment, after the continuous paper P reaches the image formation apparatus 14 disposed on the downstream side in the tandem printing system 10, the image formation apparatus 12 on the upstream side performs the blank paper sending (blank sending) of the continuous paper P in which the image formation on one side is not performed during the time period of the registration processing performed in the image formation apparatus 14 so that the portion of the continuous paper P formed with the image on one side does not reach the image formation apparatus 14 during the above-mentioned registration processing.

That is, in the processing shown in FIGS. 6 and 7, the blank paper sending (step S605) is performed in the image formation apparatus 12 in order to secure the time required for the registration processing in the image formation apparatus 14. Subsequently, timing for terminating the blank paper sending is calculated in the apparatus performing the blank paper sending (in the image formation apparatus 12), the blank paper sending is terminated on the basis of the result of the calculation (step S606), and the image formation is started (step S609).

According to this implementation, the principle in FIGS. 5A to 5C are realized. That is, even when the registration processing is performed in the image formation apparatus 14 on the downstream side, and the image formation is not performed during the registration processing in the image formation apparatus 14, the blank paper sending is performed in the image formation apparatus 12, and timing for the image formation with respect to the front and back sides of the continuous paper P is thereby adjusted so that it becomes possible to perform the image formation on the downstream side at the timing that allows the positions of the images on the front and back sides to be matched. Consequently, in the case where the types of the image formation apparatuses are different, and the registration processing is performed on the downstream side instead of performing the registration processing on the upstream side, it is possible to match the positions of the images on the front and back sides of the continuous paper P.

Operation Example 2

Figure 8:
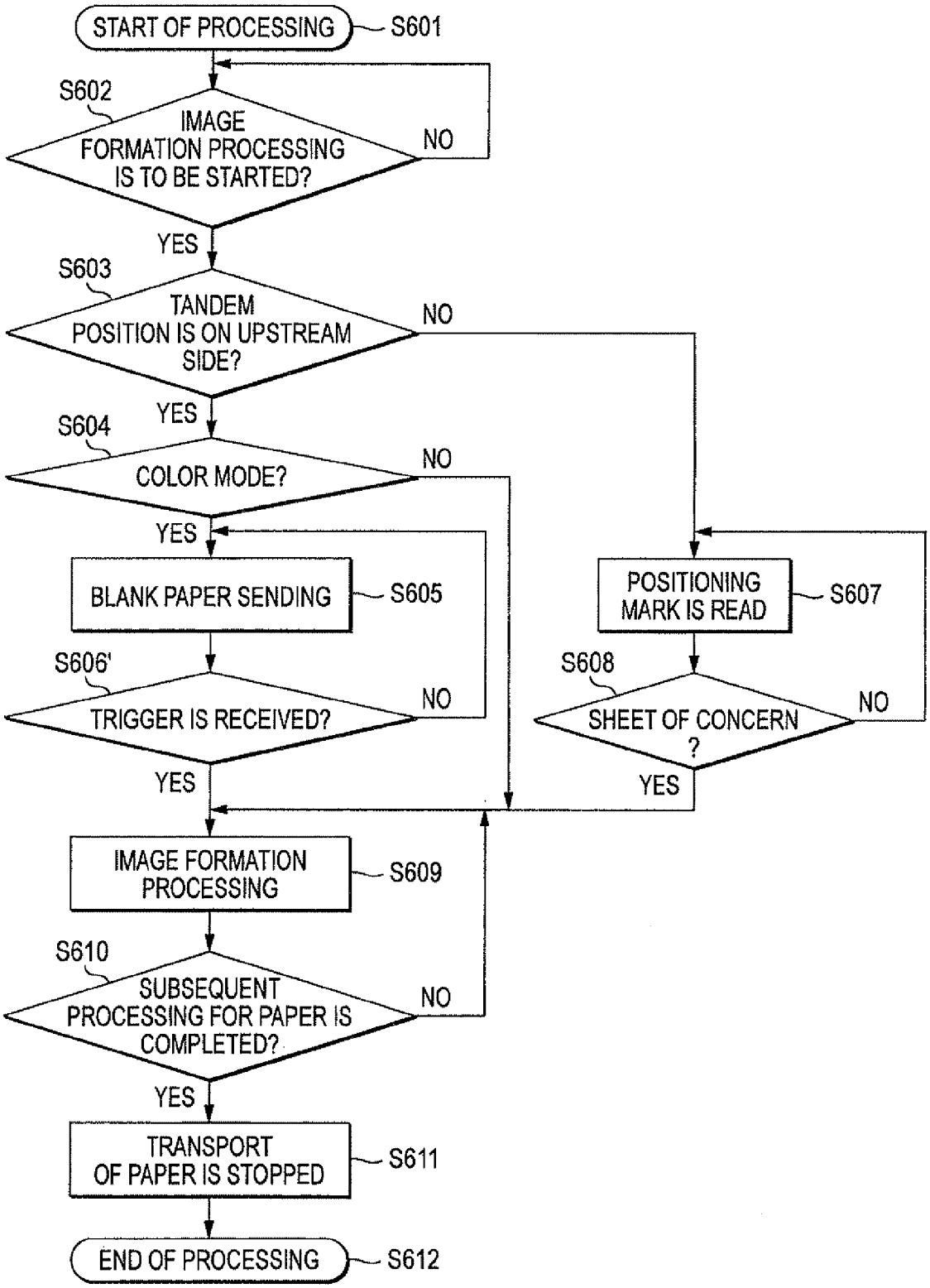
FIG. 8 is a flow chart showing an example of procedures of an operation of the exemplary embodiment.

Operation Example 2 different from Operation Example 1 will be described. FIG. 8 shows procedures of processing of Operation Example 2 that is performed in the image formation apparatus 12. In FIG. 8, parts provided with the same reference numerals of FIG. 6 are the same as those in FIG. 6. Hereinbelow, a description will be given of a part of the processing that is different from that in FIG. 6.

In the processing in FIG. 8, after the blank paper sending in the step S605 is performed, it is determined whether or not a trigger is received (step S606'). The trigger is a signal that reports the completion of the registration processing in the image formation apparatus 14. When the registration processing in the image formation apparatus 14 is completed, a signal reporting the completion is sent as the trigger to the image formation apparatus 12 from the image formation apparatus 14. Upon reception of the signal as the trigger, the image formation apparatus 12 advances the procedure to the step S609 from the step S606' to start the image formation processing. Other procedures in FIG. 8 are the same as those in FIG. 6.

Figure 9:
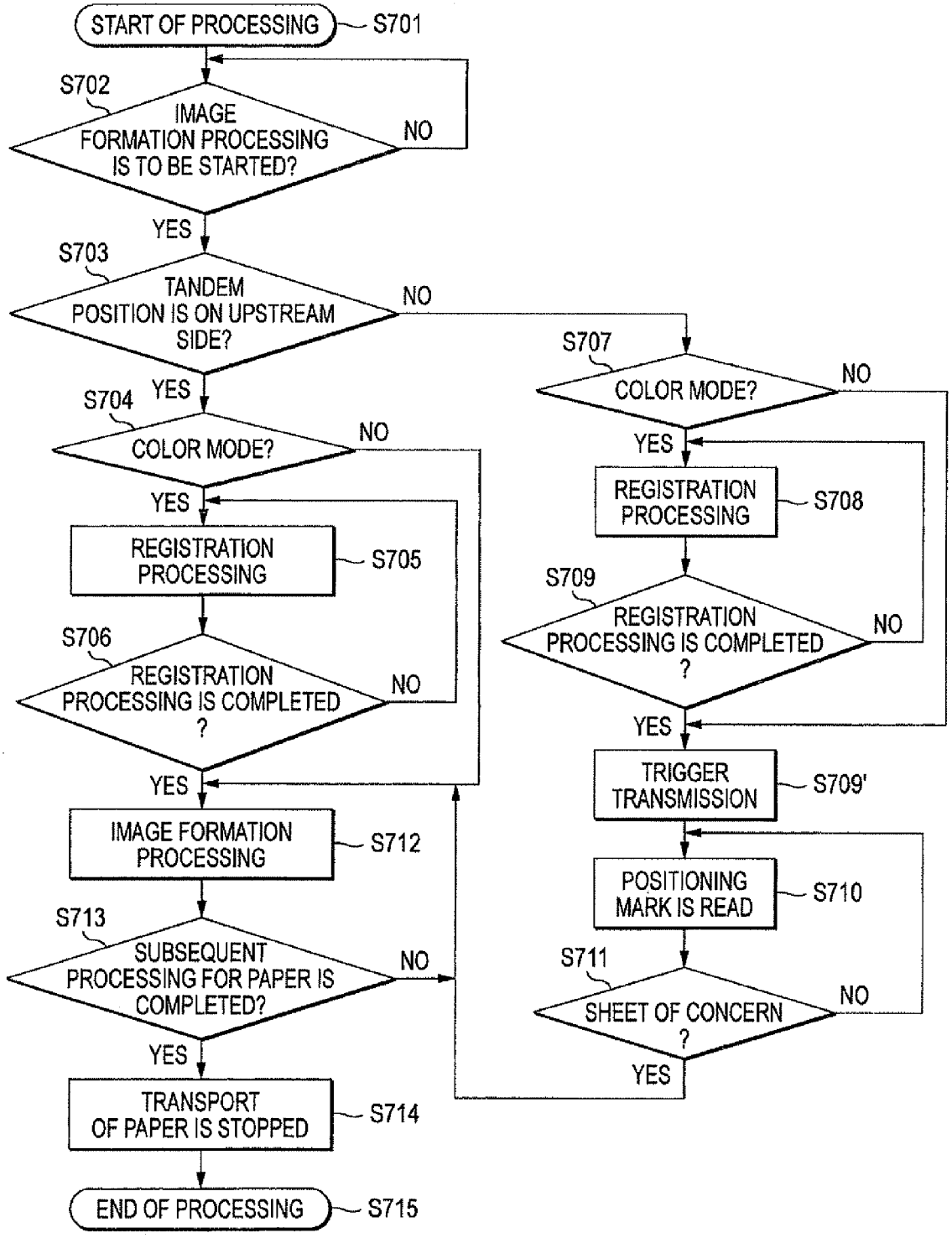
FIG. 9 is a flow chart showing an example of procedures of an operation of the exemplary embodiment.

FIG. 9 shows procedures of an operation of the image formation apparatus 14 to be paired with the image formation apparatus 12 where the processing in FIG. 8 is performed. In FIG. 9, parts provided with the same reference numerals of FIG. 7 are the same as those in FIG. 7. Hereinbelow, a description will be given of a part of the processing that is different from that in FIG. 7. In this case, at the point of time when the registration processing in the step S709 is completed, the processing of transmitting the trigger toward the image formation apparatus 12 from the image processing apparatus 14 is performed (step S709'). When the trigger is received in the image formation apparatus 12 (the step S606' in FIG. 8), the state where the blank paper sending in the step S605 is performed is shifted to the state where the image formation processing is performed (step S609).

(Feature of Operation Example 2)

In this implementation, the signal reporting the completion of the registration processing is sent to the image formation apparatus 12 from the image formation apparatus 14 on the downstream side and, upon reception of the signal, the image formation apparatus 12 stops the blank paper sending, and starts the image formation processing. Consequently, the occurrence of the inconvenience shown in FIGS. 4A to 4C are reliably prevented.

Operation Example 3

Figure 10:
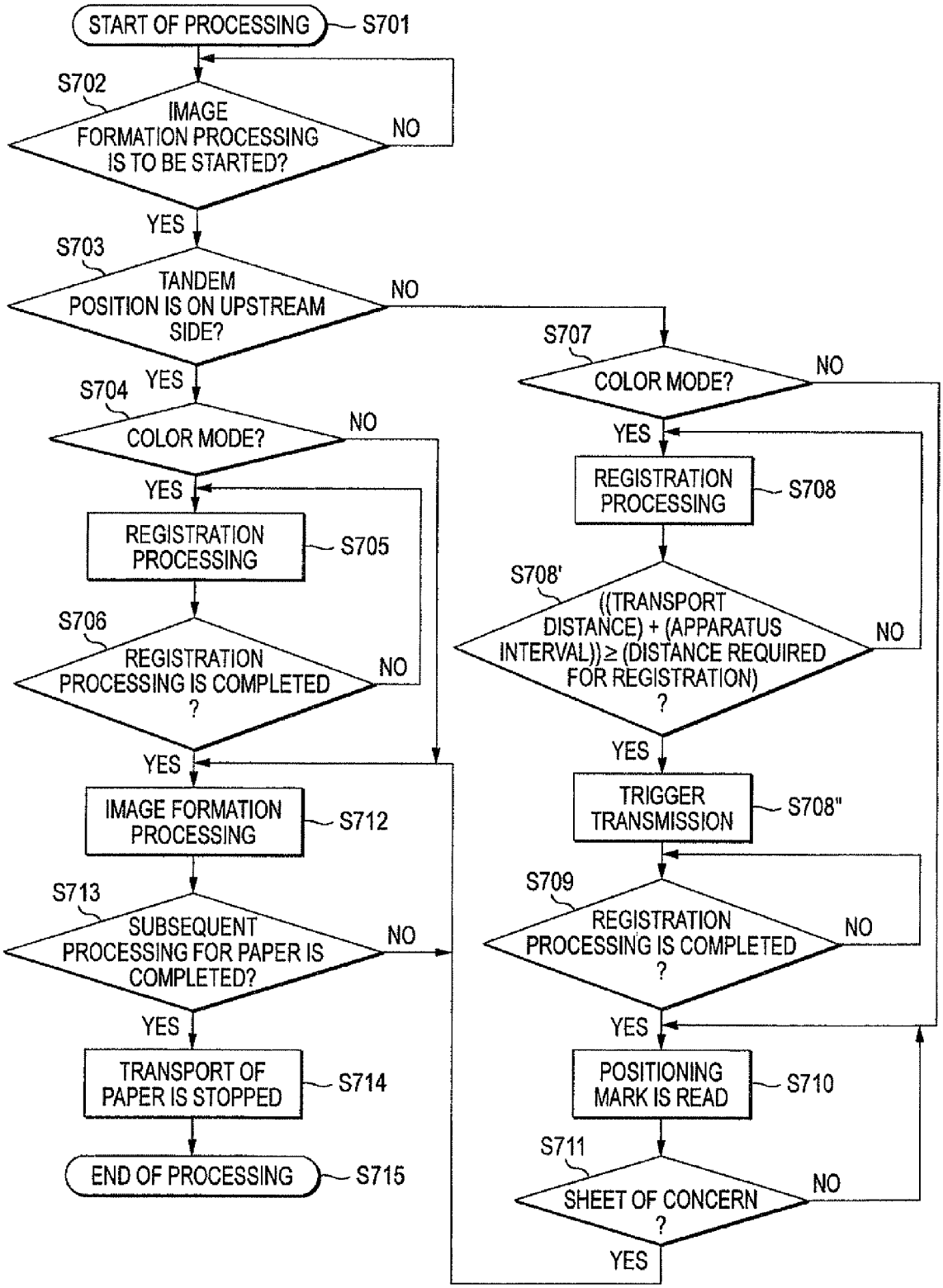
FIG. 10 is a flow chart showing an example of procedures of an operation of the exemplary embodiment.

A description will be given of Operation Example 3 that is different from Operation Examples 1 and 2. FIG. 10 shows procedures of processing of Operation Example 3 performed in the image formation apparatus 14. In FIG. 10, parts provided with the same reference numerals of FIG. 7 are the same as those in FIG. 7. Hereinafter, a description will be given of a part of the processing that is different from that in FIG. 7. Note that the operation of the image formation apparatus 12 in Operation Example 3 is the same as that in FIG. 8.

In this case, after the registration processing in the step S708 is started, a procedure in a step S708' is performed. In the step S708', it is determined whether or not the sum (L1+L2) of the transport distance of the continuous paper P after the start of the registration L1, and the distance between the image formation apparatuses 12 and 14 L2 is not less than the transport distance of the continuous paper P required for the registration processing L3.

Figure 11A:
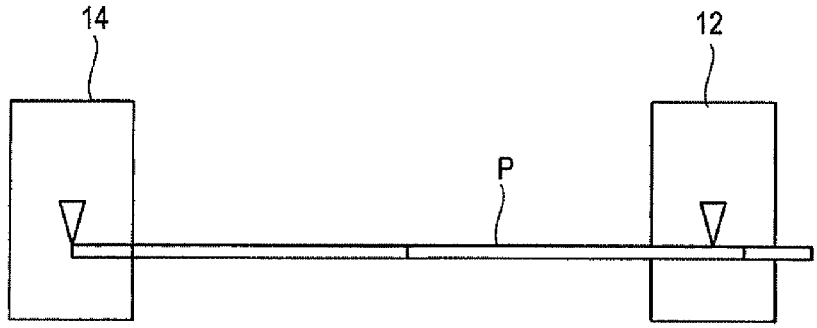
FIGS. 11A and 11B are principle views showing a principle of the exemplary embodiment.
Figure 11B:
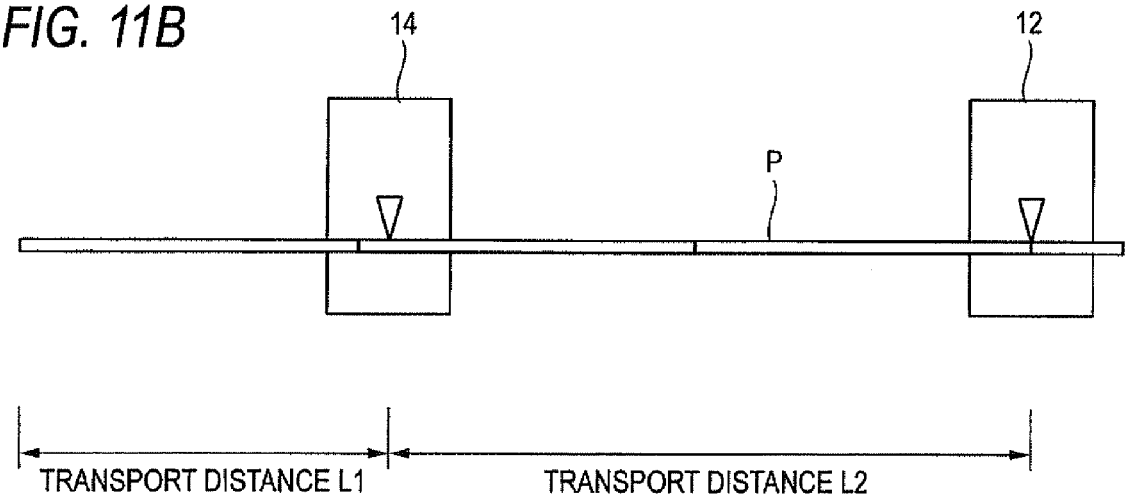

The principle of the determination content is shown in FIGS. 11A and 11B. FIGS. 11A and 11B show the transport distance L1 and the apparatus interval L2. Herein, the apparatus interval L2 is a distance between the transfer position to the continuous paper P in the image formation apparatus 12 and the transfer position to the continuous paper P on the most downstream side in the image formation apparatus 14.

In the case where the condition of L1+L2<L3 is satisfied (i.e., the condition of NO in the step S708'), when the image formation with respect to the first side of the continuous paper P in the image formation apparatus 12 is started, at the timing prior to the completion of the registration, the image formation portion on the first side reaches the transfer position in the image formation apparatus 14. Accordingly, timing for the image formation with respect to the second side in the image formation apparatus 14 is not secured so that it is not possible to perform the image formation in which the positions of the images on the front and back sides are matched with each other.

Consequently, the procedure in the step S708' in FIG. 10 is performed and, at the stage where L1+L2≥L3 is satisfied, the trigger is transmitted from the image formation apparatus 14 to the image formation apparatus 12 (step S708'). At the stage where the trigger is received, the step S606' in FIG. 8 becomes YES, and the procedure is shifted from the blank paper sending in S605 to the image formation processing in S609 in the image formation apparatus 12.

(Feature of Operation Example 3)

According to Operation Example 3, when L1+L2≥L3 in FIGS. 11A and 11B (L3: the transport distance of the continuous paper P required for the registration processing) is satisfied, the portion of the paper formed with the image on the first side does not reach the transfer position in the image formation apparatus 14 during the registration processing in the image formation apparatus 14 so that the occurrence of the inconvenience in which the positions of the images on the front and back side are not matched with each other is prevented.

In addition, when compared with the case of Operation Example 2, it is possible to reduce the amount of wasted continuous paper P. Specifically, in Operation Example 2, the image formation is started on the upstream side after the registration is completed on the downstream side, while in Operation Example 3, at the point of time prior to the completion of the registration on the downstream side, the timing for the image formation on the upstream side is calculated by arithmetic calculation using the data on the transport distance of the continuous paper P, and the image formation on the upstream side is started on the basis of the result of the calculation. Consequently, in Operation Example 3, it is possible to shorten the length of the continuous paper P to be subjected to the blank paper sending when compared with Operation Example 2. In other words, it is possible to reduce the amount of wasted continuous paper P when compared with Operation Example 2.

As another implementation of Operation Example 1, an implementation is possible in which the procedure in the step S708' is performed instead of the step S606 in FIG. 6. In this case, the processing of the procedure in the step S708' is performed in the image formation apparatus 12 and, on the basis of the result of the processing, the procedure is shifted from the processing of the blank paper sending to the image formation processing in the image formation apparatus 12.

(Others)

There may be adopted a configuration in which the program for performing the processing shown in FIGS. 6 to 9 is stored in an appropriate storage medium, and provided therefrom. Further, there may also be adopted a configuration in which the processing shown in FIGS. 6 to 9 is performed in the host terminal 50, a control signal including the result of the processing in FIGS. 6 to 9 is sent to the image formation apparatuses 12 and 14 from the host terminal 50, and the image formation apparatuses 12 and 14 operate on the basis of the control signal.

The foregoing description has described the case where, because the registration needs to be performed in the image formation apparatus on the downstream side, the additional time period from the reception of the continuous paper to the start of the operation is required in the apparatus on the downstream side. However, the reason why the additional time period from the reception of the continuous paper to the start of the operation is required in the apparatus on the downstream side is not limited to the registration processing, and the reason may include other factors such as, e.g., warming-up of the fixing apparatus, cleaning of the photosensitive drums, and the like.

INDUSTRIAL APPLICABILITY

The present invention may be utilized for a technology for performing image formation with respect to a continuous recording medium using image formation apparatuses of different types.

The foregoing description of the exemplary embodiment of the present invention has been provided for the purpose of illustration and description. It is not intended to be exhaustive or to limit the invention to the precise forms disclosed. Obviously, many modifications and various will be apparent to practitioners skilled in the art. The embodiments were chosen and described in order to best explain the principles of the invention and its practical application, thereby enabling other skilled in the art to understand the invention for various embodiments and with the various modifications as are suited to the particular use contemplated. It is intended that the scope of the invention be defined by the following claims and their equivalents.

What is claimed is:

1. A tandem printing system comprising:

a color printer configured to perform printing on one face of a continuous form; and a black and white printer configured to perform printing on the other face of the continuous form, wherein the black and white printer is connected to the color printer so that both side printing is performed on the continuous form, wherein when the both side printing is started, the black and white printer performs the printing on the one face of the continuous form after the black and white printer transports the continuous form the given distance without performing the printing, and wherein the sum of the given distance and a distance between the color printer and the black and white printer is equal to or greater than a transport distance of the continuous form required to perform registration processing in the color printer.

* * * * *